United States Patent [19]

Peterson

[11] Patent Number: 5,052,899

[45] Date of Patent: Oct. 1, 1991

[54] ANTI-SURGE COMPRESSOR LOADING SYSTEM

[75] Inventor: Clyde O. Peterson, Plum Borough, Pa.

[73] Assignee: Westinghouse Electric Corp., Pittsburgh, Pa.

[21] Appl. No.: 457,047

[22] Filed: Dec. 26, 1989

[51] Int. Cl.[5] ..... F04B 49/00

[52] U.S. Cl. ..... 417/282; 417/295; 417/310

[58] Field of Search ..... 417/282, 295, 300, 310

[56] References Cited

U.S. PATENT DOCUMENTS

| | | | |
|---|---|---|---|
| 4,080,110 | 3/1989 | Szymaszek | 417/230 |
| 4,249,866 | 2/1981 | Shaw et al. | 417/310 |
| 4,519,748 | 5/1985 | Murphy et al. | 417/310 |
| 4,976,588 | 12/1990 | Heckel | 417/18 |

*Primary Examiner*—Leonard E. Smith

*Assistant Examiner*—David W. Scheuermann

*Attorney, Agent, or Firm*—C. M. Lorin

[57] ABSTRACT

A compressor coupled to a load of smaller capacity is provided for loading with a setpoint adjusting circuit substituting a pseudo-setpoint signal for the pressure signal derived from the load, so that the master-controller operates in response to a signal increasing gradually from a low initial value until matching in magnitude with the assigned setpoint signal for normal operation. The master-controller is modified so as to bypass the normal modulation means during loading, a minimum inlet valve opening being imposed initially and concurrently the bypass valve being allowed to close under the low initial value, inlet valve control being enabled after the bypass valve has closed and in accordance with said gradual increase of the pseudo-setpoint signal. After load pressure has reached the assigned pressure setpoint in magnitude, the master-controller normal operation is reinstated.

6 Claims, 9 Drawing Sheets

ANTI-SURGE COMPRESSOR LOADING SYSTEM

CROSS-REFERENCE PATENT APPLICATIONS

The invention is related to the following copending patent applications:

1. U.S. patent application Ser. No. 547,046 filed 12/26/89, 1989, entitled "Long Term Compressor Control Apparatus";

2. U.S. patent application Ser. No. 457,049 filed 12/26/89, 1989, entitled "Compressor Demand Control System for Long Term Compressor Operation".

These two cross-referenced patent applications are hereby incorporated-by-reference.

BACKGROUND OF THE INVENTION

The compressor control system is illustrated in the context of the inventions disclosed in the aforestated U.S. patent applications. The present invention combines, for an overall treatment of a compressor system, the operation from loading to unloading, as well as for a long term under a continuous, or discontinuous, load demand. In this context, the present invention copes with the situation when a compressor is used working into a small capacity system, what would have the unfavorable consequence, when loading, of calling for an excessive demand for airflow in order to meet the assigned setpoint pressure of the compressor system of larger capacity. The excessively large flow toward the small tank will result in a backlash into the compressor, and a surge. As seen from the master-controller, the operation involves a setpoint assigned to the system. When a large compressor is used with a tank which is of smaller capacity, the reaction to the air pressure building too quickly during loading will cause the system to overshoot the setpoint assigned by the operator, and a surge will occur due to such overpressure.

It is known from U.S. Pat. No. 4,080,110 to provide a variable capacity gas compressor, thereby to meet the requirements of the load by regulating the capacity of the compressor.

The present invention involves a constant airflow compressor of relatively large capacity in operation with a small capacity system. Adjusting the parameters of the control system to increase the rate of response to meet the overshoot will not do, because, under inlet valve modulation, the inlet valve will tend to respond to the overshoot by closing too quickly toward the minimum air flow position P2, thereby undershooting the limit valve position so that, again, a surge will occur.

SUMMARY OF THE INVENTION

A compressor control system controls a compressor operating in accordance with a pressure setpoint signal representative of a desired tank pressure and with a feedback signal representative of the present tank pressure. The compressor generates fluid flow into a tank outputting fluid flow to a user's load. The tank has a substantially smaller capacity than the compressor. The system includes : a master-controller responsive to said setpoint and feedback signals for modulating successively the inlet valve and the bypass valve of the compressor, a limit position being assigned to the inlet valve 1/ as a final position thereof to be reached when decreasing compressor flow under inlet valve modulation and 2/ as an initial position for the inlet valve modulation when increasing the flow following bypass valve modulation. Upon loading, means are interposed between said setpoint signal and the master-controller for introducing at least one ramping setpoint of predetermined rate increasing from a lower level until normal load operative pressure has been established, thereby to prevent a surge due to the smaller capacity tank generating a feedback signal of excessive magnitude under loading.

In a more general setting, the compressor control system according to the invention further includes: 1. subcontroller means operative, once loading has been established, for automatically maintaining the inlet valve limit position during bypass valve modulation, and 2. means for establishing an offset limit as a temporary step toward the limit position of the inlet valve, should a sudden decrease of the feedback signal occur at a high rate.

DETAILED DESCRIPTION OF THE INVENTION

Figure 1:
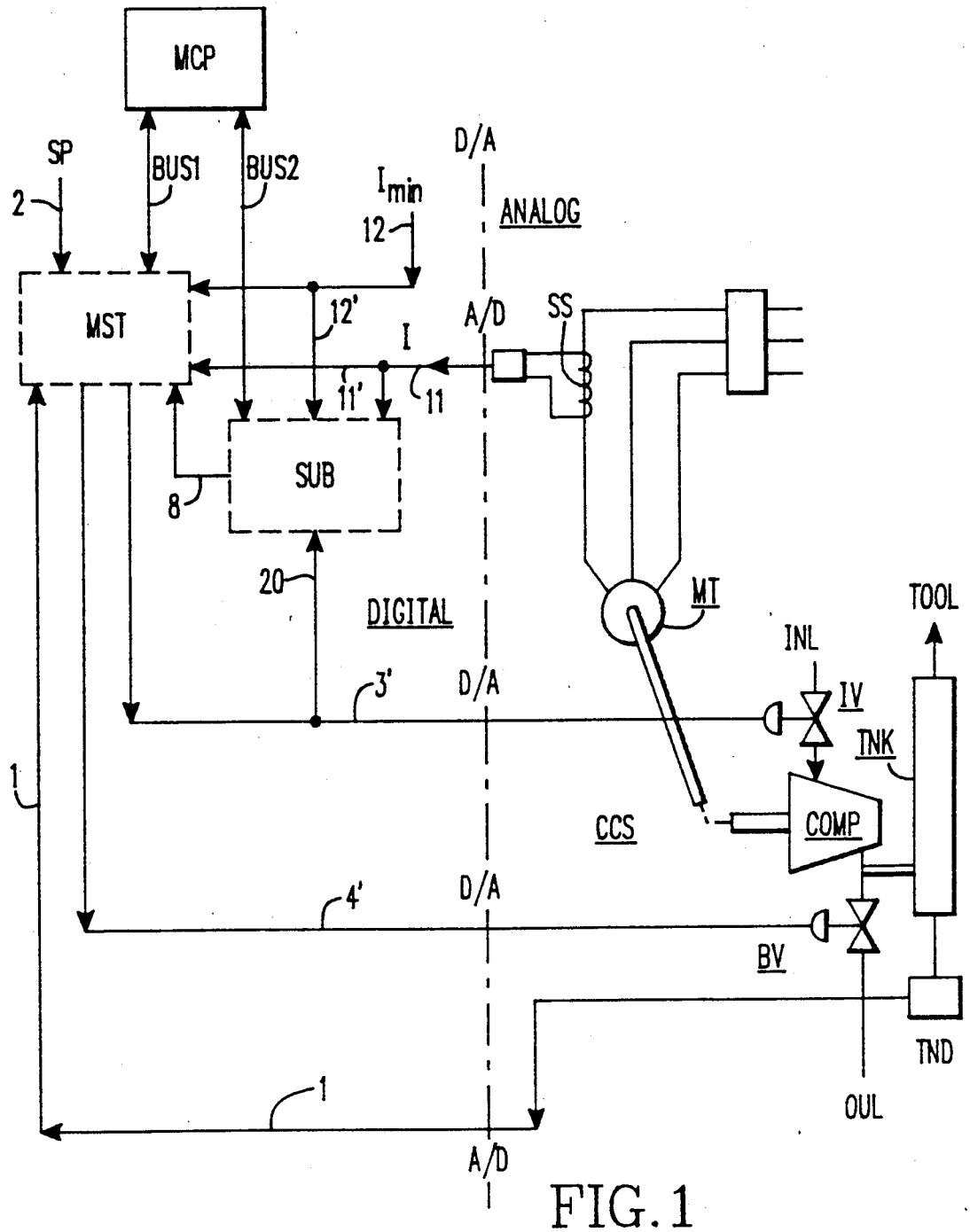
FIG. 1 is a diagram showing a compressor control system with its master-controller and a sub-controller.

FIG. 1 shows a compressor COMP associated with a tank TNK supplied with air by the compressor through a check valve CV and supplying compressed air to a tool, as generally known. The inlet valve IV of the compressor, when in a particular open position will determine an airflow rate, derived from the compressor inlet INL at atmospheric pressure, and delivered by the compressor through a check valve. Enough air is supplied to maintain a predetermined pressure within the tank as the tool is using the reserve of the gas at its own flow rate. In normal operation there is as much air flowing from the compressor into the tank as there is air being consumed by the tool, thus, to maintain the operative tank pressure. At the input of the master-controller MST, there is a setpoint applied on line 2 which establishes, by control therethrough, the pressure to be maintained in the tank. This setpoint is compared with a pressure signal feedback by line 1 from a transducer TND measuring the pressure in the tank. Should under the demand of the tool such pressure be reduced, line 1 will translate this into an error relative to the setpoint of line 2 and an error signal will appear on line 3 at the output of subtractor S1. Illustratively, the compressor control system (besides the master-controller) includes a sub-controller SUB, the latter being like the one shown in first cross-referenced and incorporated-by-reference patent application.

Figure 2:
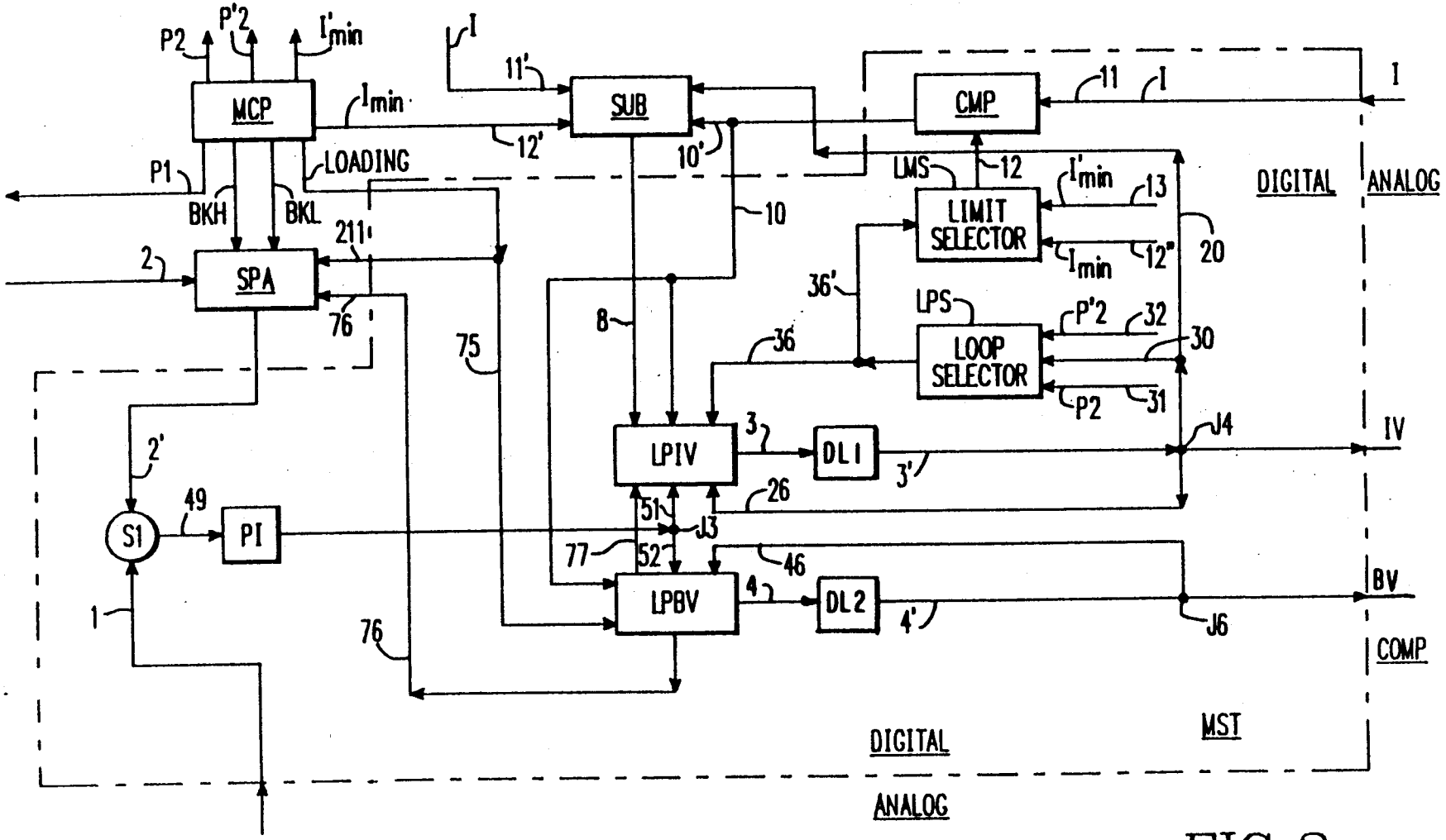
FIG. 2 shows the compressor control system of FIG. 1 embodying the setpoint adjusting circuit according to the present invention.

Referring to FIG. 2, the master-controller and the subcontroller are under monitoring and control of a microprocessor MCP (for instance, an INTEL 8031). The master-controller provides control for the inlet valve IV (on line 3'), or for the bypass valve BV (on line 4') of the compressor, in accordance with a setpoint pressure (applied on line 2) and a feedback pressure signal (derived on line 1) from the transducer TND. The tank TNK is energizing a tool and is supplied with air from the compressor through a check valve CV. The subcontroller derives on line 20 a present command for the inlet valve position IV, and generates a corrected value on line 8 which is supplied instead to the master-controller. The instant current I of the motor MT driving the compressor (at constant speed) is sensed and applied on line 11 to the master-controller and on line 11' to the subcontroller.

Referring to FIG. 2, the master-controller MST preferably is like the one described in the second cross-referenced patent application. Instead of a single inlet valve control loop extending, via line 49, to the PI loops and junction J3 (then, to the inlet valve control line 3') there are now two inlet valve loops. One of them is identified as LP2', the other as LP2'. One is responsive to a limit P2', the second to a limit P2. For the sake of clarity, these two loops of the cross-referenced application are illustrated in FIG. 2 as a single block LPIV having associated a loop selector LPS which (like the J-K flip-flop FP shown in the cross-referenced patent application) responds to the limit P2' (line 32) in the downward direction from normal inlet valve modulation, or to the limit P2 (line 31) in the upward direction when returning to normal inlet valve operation. Selection of one loop, or the other, is effectuated by the logic of line 36 from circuit LPS. Line 36 goes by line 36' to a limit selector LMS which determines whether comparator CMP will respond to a motor current reference I'min (somewhat higher than the minimum I'min) received by circuit LMS from line 13, or to the minimum motor current Imin (received on line 12''). As explained in the two crossed-referenced patent applications, comparator CMP responds to the motor current as sensed, which (for the motor constant speed and a given airflow) represents the degree of closing, or opening of the inlet valve IV, and by line 10 commands the change of mode from inlet valve to bypass valve modulation, when the minimum I'min has been reached downward. At the same time, the subcontroller SUB (enabled by lines 10 and 10' from comparator CMP) will monitor any deviation between the motor current (line 11') and the limit Imin (line 12'). It will also compensate for any such deviation by amending the value of the present inlet valve position of line 3' at junction J4 (received by the SUB via line 20) while providing on line 8 the new, or amended, value which is passed by block LPIV onto line 3'.

Figure 3:
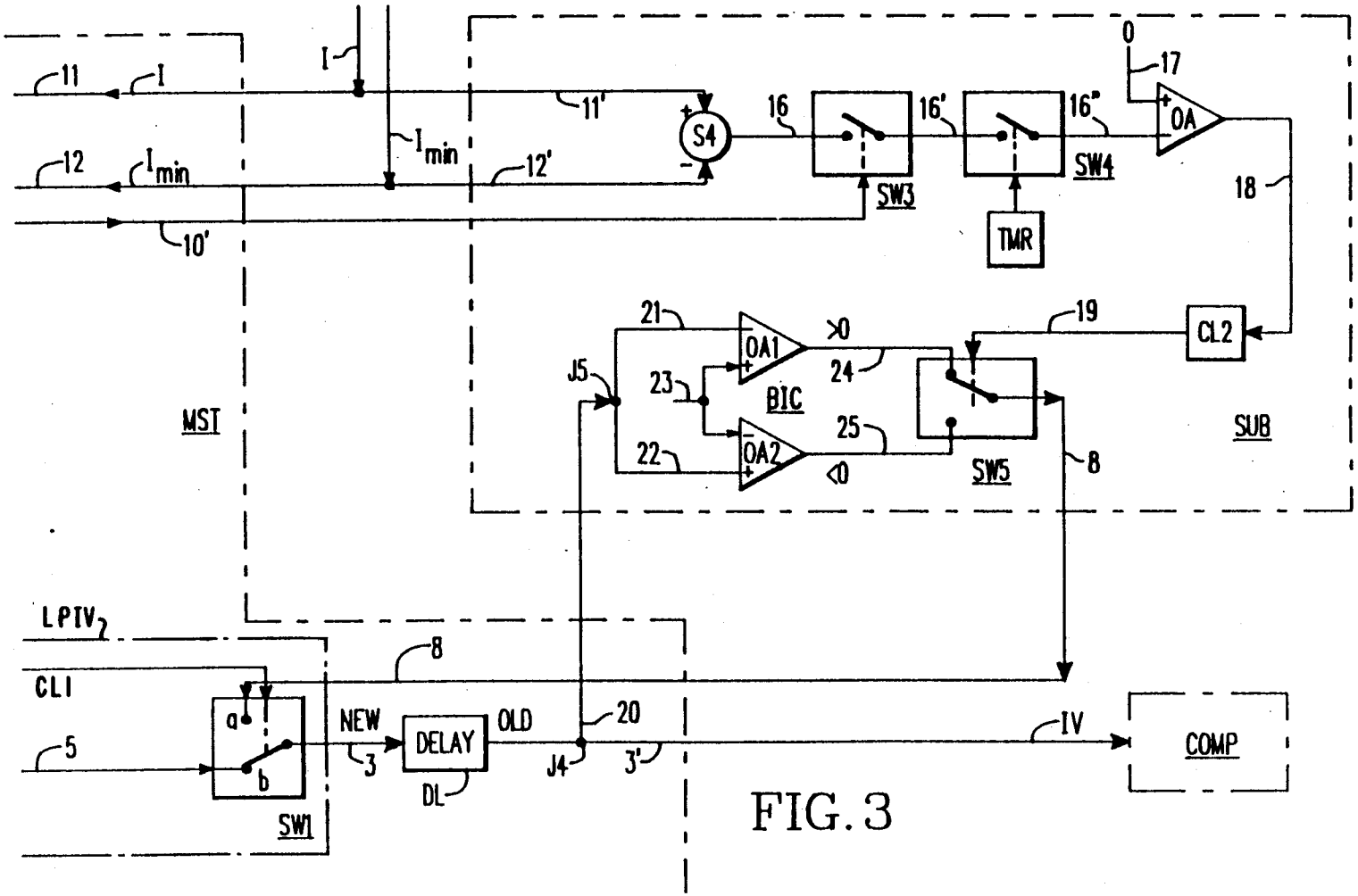
FIG. 3 shows specifically the subcontroller of FIG. 1.

FIG. 3 shows the subcontroller with line 20 reaching at junction J5, a bidirectional circuit BIC which increments from line 23 by delta amounts the present value of line 3', in accordance with the sign of the error (line 16) detected by comparator OA and supplied by lines 18 and 19 to the loop selecting switch SW5. This has been described in the cross-referenced patent application.

The overall setting and operation of the master-controller is as follows :

Line 1 carries the feedback pressure signal to be compared by subtractor S1 with the assigned setpoint SP of line 2', so as to derive an error which is converted (by the proportional-plus-integral (PI) loop leading, through a summer, to a junction J3) into a demand for correction signal ΔIV, or ΔBV, appearing at junction J3. The latter represents a demand for a change of airflow either $1)_k$ through the inlet valve (such a flow level corresponding to IV+ΔIV) as required to nullify the error between lines 1 and 2, or $2)_k$ through the bypass valve (such a flow level corresponding to BV+ΔBV) to the same effect. Thus, FIG. 2 generally shows the master-controller MST responding to a demand for IV, or BV, compensation by the amount ΔIV, or ΔBV, appearing on junction J3. From there, line 51' (through loop LP2'), line 51 (through loop LP2), or line 52 (through loop LPBV) will cause on lines 3', or line 4', a certain amount of valve modulation, for the corresponding valve (IV, or BV). This depends upon which valve is being modulated, according to switches SW1 and SW2. Normally, as shown in FIG. 1, upon such an error, after a proportional plus integral loop PI, and a summer of the individual proportional and integral loops (KP and INT), junction J3 will go either to loop LPIV outputting a control signal for the inlet valve IV (line 3') if control of IV is used by the system to maintain the error of line 3 to zero, or to loop LPBV if the bypass valve is used to reduce substantially the pressure within the tank under specific conditions, such as unloading. Whether there is inlet valve, or bypass valve modulation, depends upon line 10 from comparator CMP. There is a limit position P2 for valve IV when closing in order to maintain a minimum airflow through the compressor. When, under inlet valve modulation, IV reaches such limit position P2, this is detected by comparator CMP receiving from line 11 the motor current I (since the compressor is driven at constant speed and the current at any moment represents the level of airflow, thus, the opening state of valve IV) as sensed, and a reference signal on line 12 representing the state of the motor current if the airflow is at the assigned minimum. Thus, when the inlet valve reaches the minimum airflow level, comparator CMP commands a coil CL1 to shift switches SW1 and SW2 to their b positions. At that moment, the present (after a delay DL) inlet valve position just applied on line 3' is being derived by line 20 and applied to the subcontroller SUB which, in relation to any deviation from the minimum inlet valve position (detected by comparing therein the instant current I of lines 11, 11' and the minimum current Imin applied on line 12'), corrects internally the value of the signal of line 20 and applies, by line 8, the corrected value to line 3'(behind the delay DL), via switch SW1 (then, in its position b). The subcontroller is shown in details in FIG. 2, as described in the first cross-referenced patent application. There, the error between lines 11' and 12' is applied by line 16 through a switch SW3 which is closed (by coil CL1 and lines 10, 10') when there is transfer to bypass valve modulation. The error is intermittently passed (by a switch cyclically closed and open under a timer TMR) onto a comparator detecting the sign of the error (relative to a reference zero on line 17). As a result a coil CL2 will either place switch SW5 onto a positive, or a negative loop, for line 8. In one instance, the bidirectional incremental circuit BIC will add to junction J5 (and the present inlet valve signal of line 20) an increment delta received from line 23. In the second instance, the BIC circuit will decrement by the amount delta of line 23 the present value of lines 3' and 20.

Figure 4A:
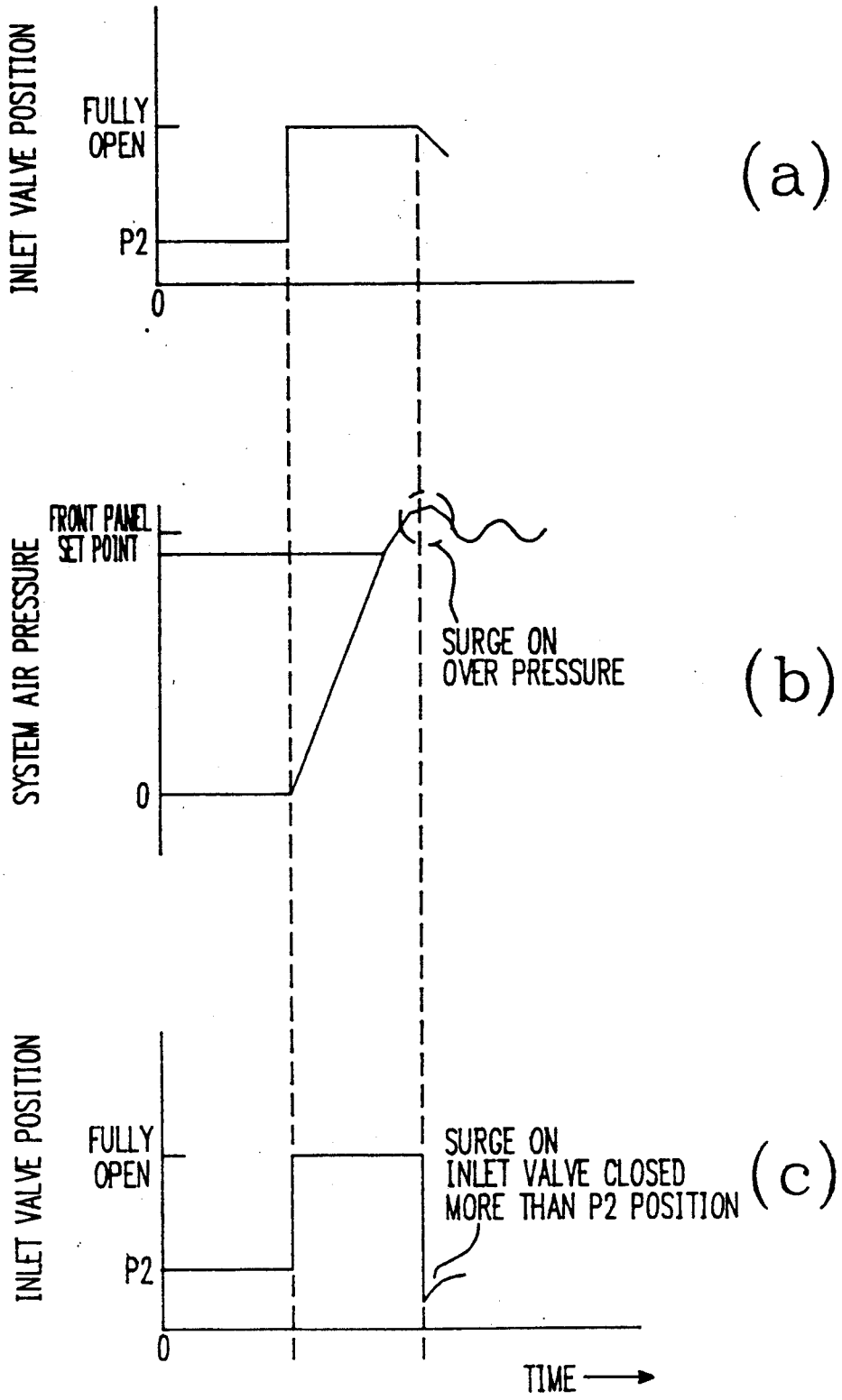
FIGS. 4A and 4B illustrate with curves the principle of operation of the setpoint adjusting circuit added to the master-controller of FIG. 2 according to the present invention.
Figure 5:
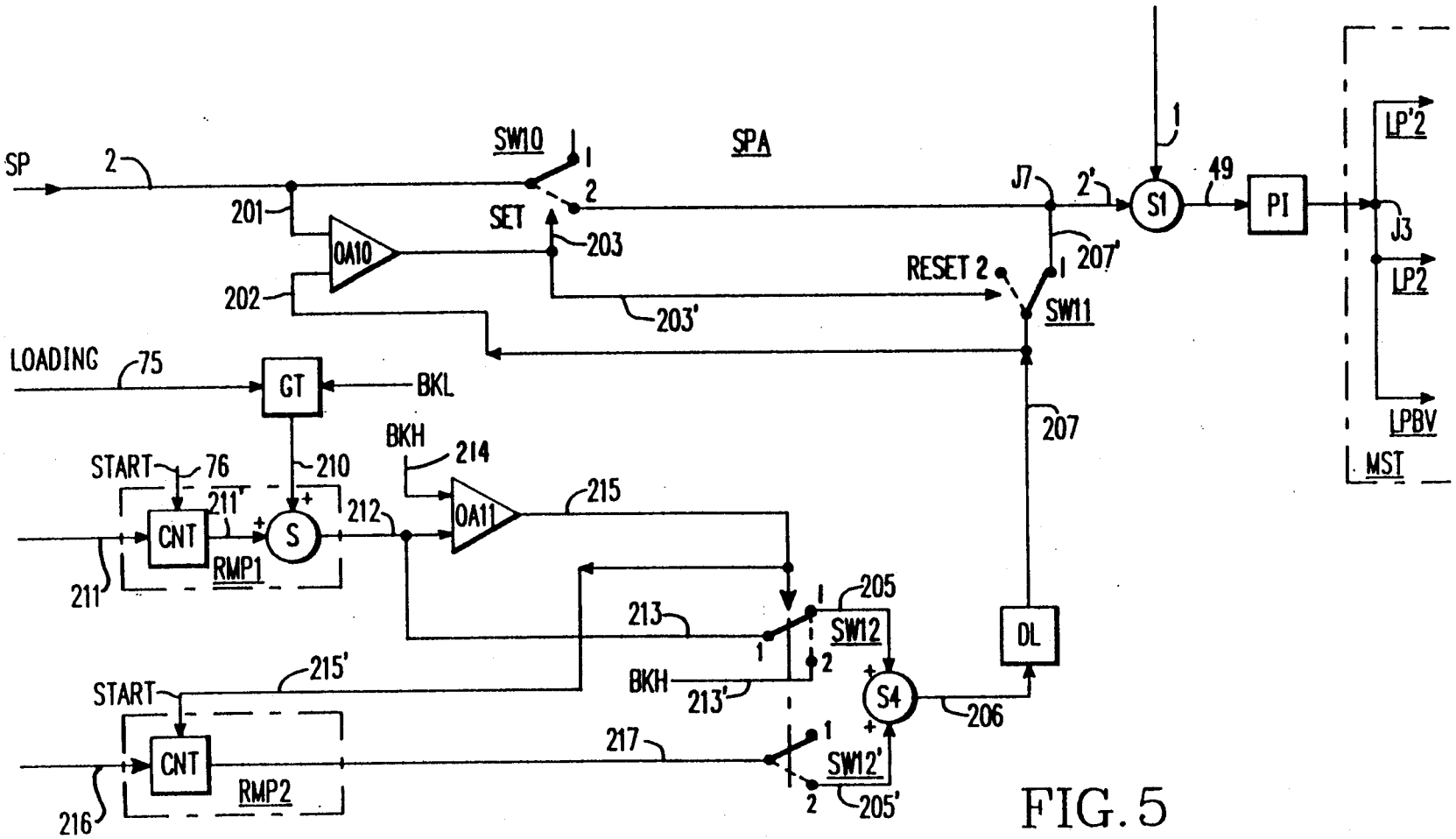
FIG. 5 is a diagram representation of the setpoint adjusting circuit according to the present invention.
Figure 6:
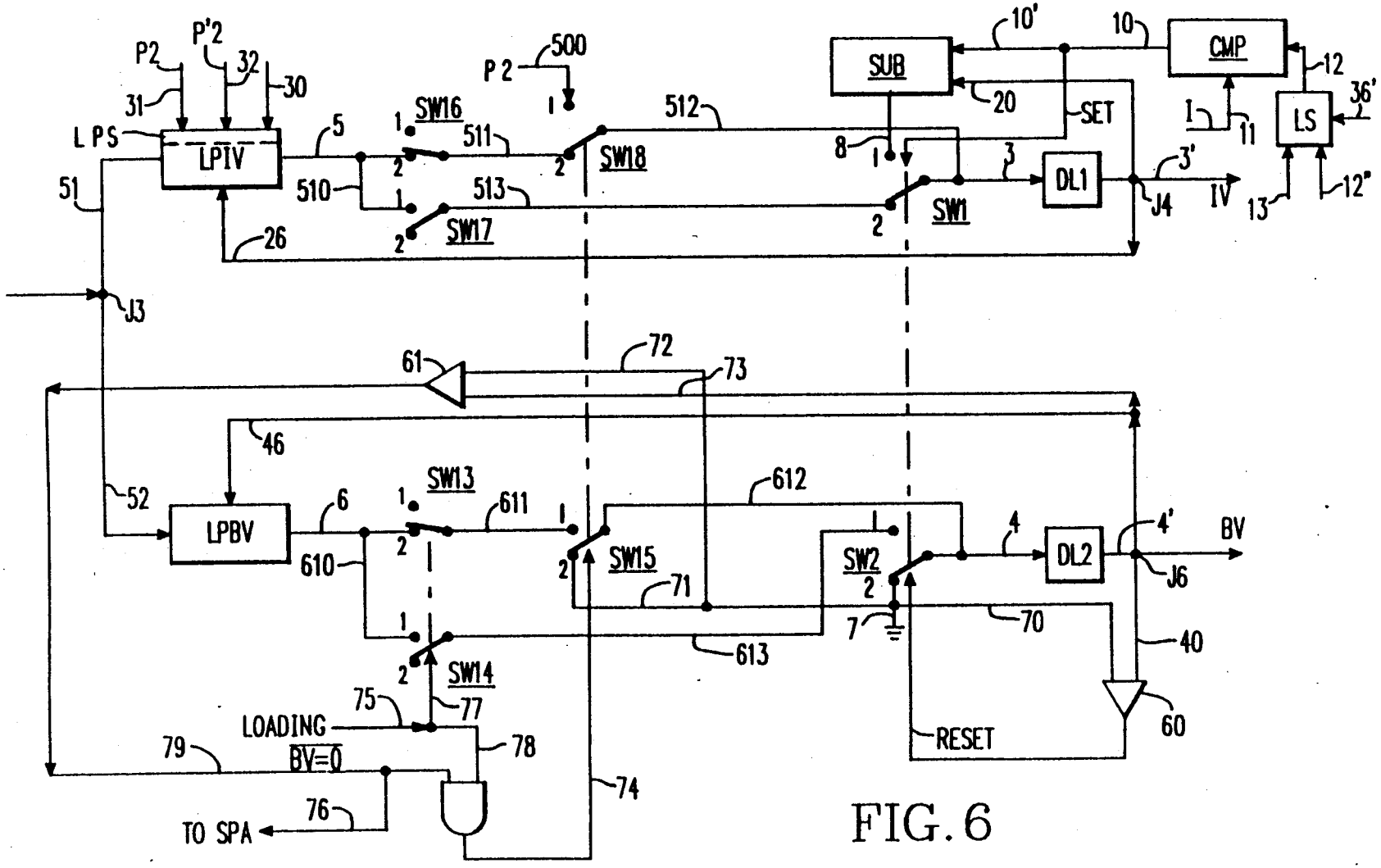
FIG. 6 shows how the master-controller has been modified to accommodate, during loading, the operation of the setpoint adjusting circuit of FIG. 5.
Figure 7:
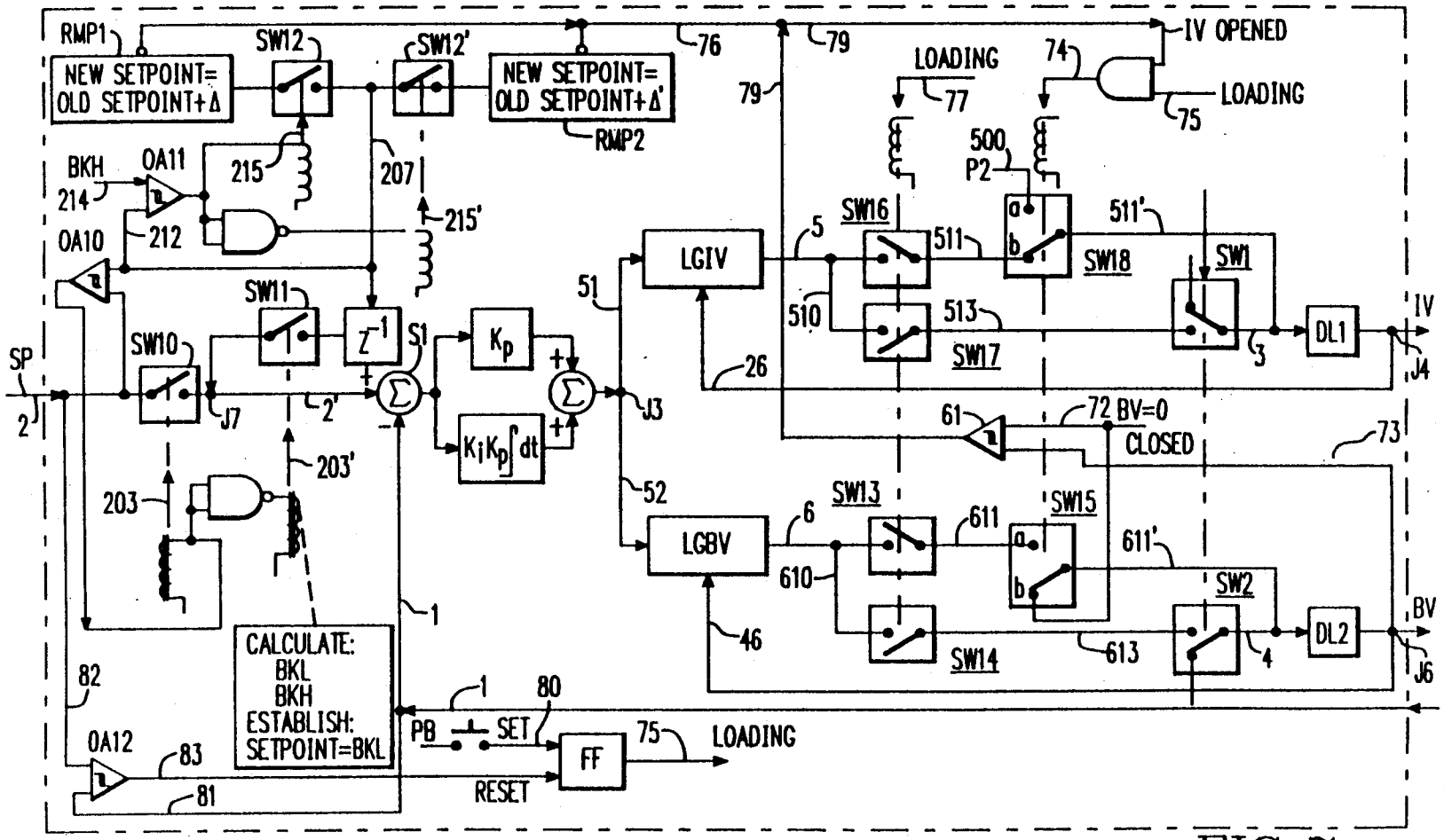
FIG. 7 is another representation of the setpoint adjusting circuit of FIG. 5 and of the master-controller of FIG. 6.

Referring again to FIG. 1, according to the present invention, to the circuitry just described is added a setpoint adjusting circuit SPA interposed between line 2 (applying the intended normal setpoint for the master-controller) and line 2' (applying during loading a selected "pseudo-setpoint" value for subtractor S1 establishing the controlling error with the signal of line 1). The operation of circuit SPA is illustrated graphically in FIGS. 4A and 4B. FIGS. 5 illustrates in diagram form the functional characteristics of circuit SPA. FIG. 6 shows how the master-controller MST is modified to accommodate the operation of circuit SPA. FIG. 7 shows, still in diagram form, but more in analogy with microcomputer control, both the SPA and the MST circuits of FIGS. 5 and 6.

The problem which calls for the solution according to the present invention arises when loading a compressor which is coupled with a smaller capacity system. The bypass valve which was totally open is now modulated for closing. An initial inlet valve minimum opening, say P2, had been established before its closing, and it will be established again for the inlet valve at the time of loading. Loading is based on an intended operative setpoint pressure, applied on line 2, which matches the pressure intended for the tank when operating. Therefore, the master-controller, in the prior art, will command an inlet valve opening sufficient to reach such assigned pressure. Curve (a) of FIG. 4A shows the inlet valve position going from P2 to fully open in order to get there. Because of such fast reaching of the new setpoint, as shown by curve (b), the system airpressure leads to a surge due to over pressure. In the latter case, once at normal pressure setpoint, the return to position P2 (bypass valve modulation substituted for inlet valve modulation) is assumed to be slow. In contrast, curve (c) shows a fast return to position P2. In that case, under the system own inertia, the inlet valve will exceed the intended P2 position, and a surge will occur.

Figure 4B:
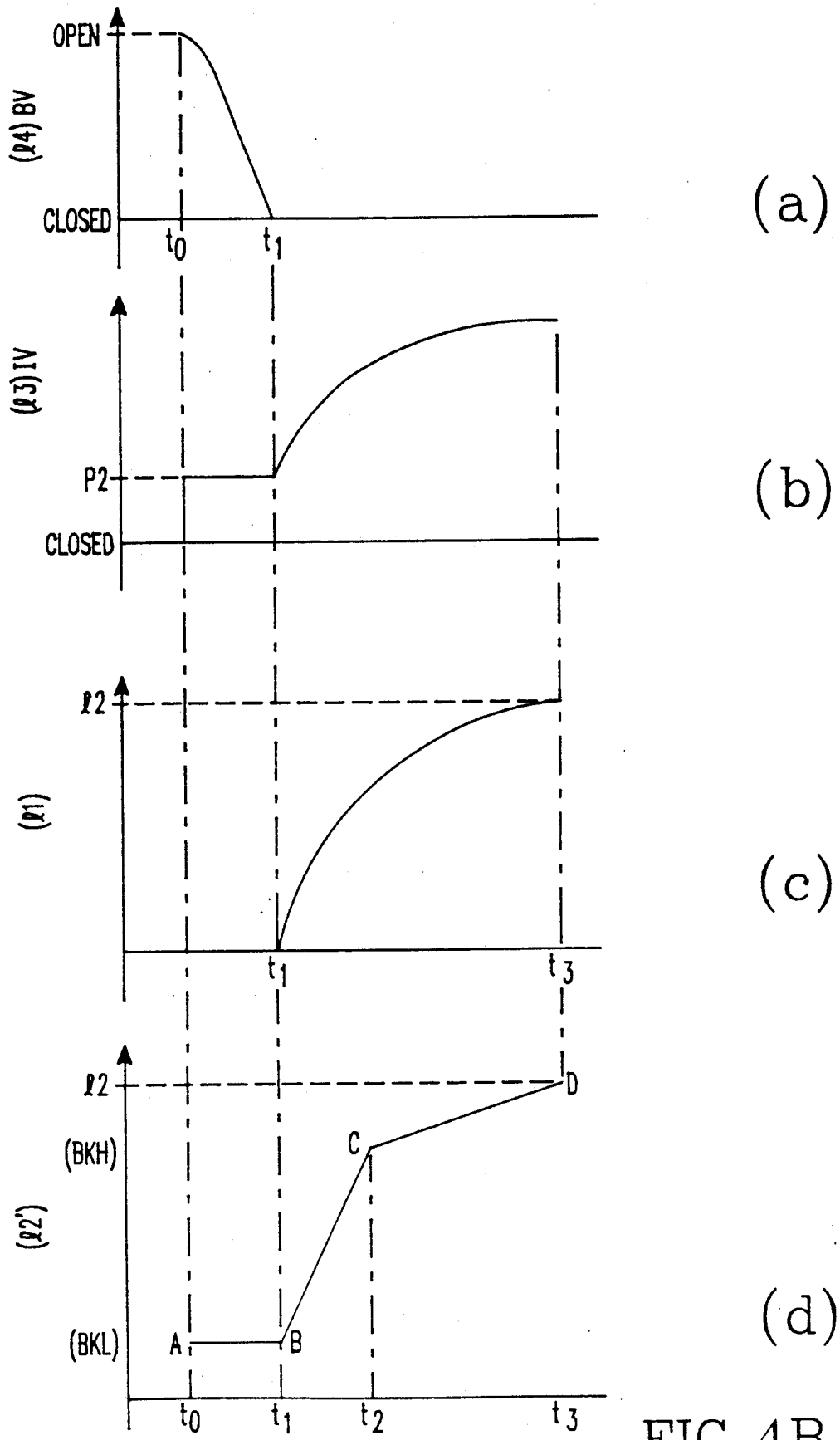

Referring to curve (d) of FIG. 4B, it is now proposed to impose to the master-controller a "pseudo-setpoint" which at instant $t_1$ ramps (at point B) from a low level (BKL corresponding to minimum airflow, or minimum inlet valve position P2) toward the intended level of line 2 (reached at point D and instant $t_3$) until the pressure in the tank has had time to be established (see curve (d) showing the feedback pressure, i.e. the signal of line 1 in FIG. 2). The surge is avoided because the inlet valve IV, as shown by curve (b), will have been, in response to the setpoint of line 2 and the feedback signal of line 1, positioned gradually from its initial position P2—established at instant $t_o$, upon "loading", and left until instant $t_1$ when the bypass valve will have become closed as shown by curve (a)—to the desired opening as shown by curve (b). As illustrated by curve (d), when "loading" the intended setpoint is replaced initially by a "pseudo setpoint" signal (line 2' of FIG. 5) which until BV=0 will be kept at a low level BKL (from A to B), then, at breakpoint B the signal of line 2' will ramp with a selected slope, until at instant $t_2$ (point C) there is another breakpoint (high level BKH reached. Thereafter, another but smaller slope of increase is selected and used to ramp from the BKH level until the intended setpoint (point D) is reached, at instant $t_3$, matching the originally assigned setpoint (of line 2 in FIG. 5). When "loading" (instant to) the inlet valve is placed with an opening P2 corresponding to minimum airflow through the compressor. When the bypass valve closes (instant $t_1$) the inlet valve becomes controlled by the master-controller in accordance with the ramping portions of curve (d). As a result, as shown by curve (b) the inlet valve will open gradually from its position P2 to the final operative opening, the inlet valve being assumed, then, to be fully opened. At the same time, as shown by curve (c), the system air pressure (line 1 in FIG. 2) will establish itself gradually to the level matching the assigned setpoint pressure of line 2. If the inlet valve, as with the prior art, had jumped immediately to fully open when attempting to meet the goal on the tank pressure, the small capacity of the tank would have blocked the massive incoming airflow from the higher capacity compressor, and the resulting backlash into the compressor would have caused a surge.

Referring to FIG. 5, the setpoint adjusting circuit SPA of FIG. 2 is shown in block diagram. When the operator at instant $t_o$ presses a push-button (PB) for "loading", the inputted setpoint signal of line 2 is barred, by a switch SW10 taking the open position (position 1), from reaching a junction point J7 with the input line 2' and subtractor S1. Instead, line 2 goes by 201 to one input of a comparator OA10. Also, upon the operator pressing the "loading" push-button at instant $t_o$ (curve (d) of FIG. 4B), a gate GT is gated by the loading command to establish by line 210 a setpoint signal of low level BKL, (corresponding to the lower elbow of the curve). BKL is applied, through a summer S, by lines 212, 213, over switch SW12 (in position 1) and by line 205, through another summer S, to line 206 where a delay DL goes by line 207, through a switch SW11 (in position 1), onto junction S7 and line 2'. Line 210 goes into a ramp RMP1 where it joins summer S, the latter receiving the output 211' of a counter CNT counting a clock signal "delta" of a rate corresponding to the slope from B to C of curve (d). However, counting within ramp RMP1 starts only when line 76 initiates it, and this occurs at instant $t_1$ when BV=0, as explained hereinafter by reference to FIG. 6. Therefore, at instant $t_1$, counter CNT of ramp RMP1 is started by line 76 to count pulses each of an incremental amount delta, as received from line 211. These are increments accumulated and added to the initial value BKL received by the associated summer S. Therefore, the output of lines 212 and 213 will increase at the rate prescribed by the discrete and recurring values of the delta clock signal of line 211. Line 212 is inputted into a comparator OA11 receiving at another input (on line 214) a threshold value BKH corresponding to the higher knee of curve (d) of FIG. 4B (reached at instant $t_2$). When this occurs, the OA11 comparator output (lines 215 and 215') starts a counter CNT within a second ramp RMP2 to count the successive pulses of a clock signal of lower incremental value delta', received on line 216. Therefore, these pulses are accumulated as increments and outputted by the counter on line 217. At the same time as comparator OA11 responds to. the threshold BKH being reached, the inputted value of lines 212 and 213 (which has become equal to the value BKH of line 214) is cutoff from line 205 by switch SW12 being switched into position 2 under the controlling line 215 from comparator OA11. In position 2, switch SW12 applies the value BKH from line 213' to line 205, and a summer S receives (as input in addition to line 205) the count initiated on line 217 by ramp RMP2. Ramp RMP2 has been started by line 215' from comparator OA11. This means that the increments of the delta' clock signal of line 216 are accumulated by the corresponding counter CNT and passed, over switch SW12' in position 2, onto line 205'. The associated summer S adds them up to the value BKH of lines 213' and 205. Therefore, at the output thereof, line 206 passes the new value through the delay DL onto line 207. The generated signal of line 2' and junction J7 has, thus, the matching characteristics (slope, time and ordinates) of curve (d) of FIG. 4B from the first to the second elbow, and beyond. While loading (with switch SW10 open, and switch SW11 closed), the time comes when the value of lines 207' and 2' becomes equal to the assigned value of line 2. This is detected by comparator OA10, due to line 202 derived from line 207 being compared with line 201 from line 2. When this occurs, switch SW10 closes (under a command from line 203) and switch SW11 opens (under a command from line 203'). However, loading is not terminated for the master-controller until the pressure in the tank has had time to match the assigned setpoint of line 2 (now on line 2'). The master-controller is responding directly to line 2 and the assigned setpoint for normal inlet valve modulation, but, the modifications called for within the master-controller for loading will not be eliminated for normal inlet valve and bypass valve modulation in response to the feedback pressure of line 1 until loading has been terminated, as explained hereinafter.

Referring to FIG. 6, the master-controller is shown as modified in order : 1. to carry bypass or inlet valve modulation until and after loading, in accordance with the afore-stated cross-referenced patent applications; and 2. to accommodate during loading the operation of the SPA circuit, just described. The inlet valve loop proper LPIV (under normal inlet valve modulation) responds to nodal point J3 by lines 51, 51', operating under respective limits P2' and P2 (on lines 32 and 31) for the present inlet valve position of line 3', at junction J4, and of line 26. Line 30 selects one of the respective loop functions within LPIV, as explained in the second cross-referenced patent application. Similarly (under normal bypass valve modulation) LPBV responds to nodal point J3 by line 52, operating under the present bypass valve position of line 4', at junction J6, and of line 46. In each instance switches SW1 and SW2 choose whether there is inlet valve modulation (LPIV) or bypass valve modulation (LPBV).

When initiating "loading" at instant $t_o$, line 75 will cause switches SW16, SW17, SW13 and SW14 to go from position 1 to position 2, thereby establishing for the respective function generators (LPIV and LPBV) a bypass of SW1 and of SW2. At that time switches SW18 and SW15 each are in position 1. Therefore, switch SW18 is placing line 512 under a command signal carried on line 500 which insures that the inlet valve be initially in an open position P2 (P2 is the valve position corresponding to a minimum airflow, as explained in the afore-stated patent applications). At that time, the output line 5 from LGIV goes over switch SW16 onto line 511, but, with no effect since switch SW18 is not yet in position 2. At this time, the initial value BKL has been applied by line 210 to ramp RMP1 (FIG. 5) and this value is the initial setpoint of line 2'. Therefore, the bypass valve BV, which was opened before loading, will (through line 52 and LPBV) start closing under the control signal over line 6, switch SW13, line 611, switch SW15, and line 4 to delay DL2. When at instant $t_1$ the bypass valve closes (BV=0), the bypass valve position value appearing on line 4' (after delay DL2) and passed on line 73 to a comparator 61, will match the threshold of the comparator (derived from line 7 and line 72 for BV=0). As a result, by line 79, an AND device (cumulating the loading condition with the BV=0 condition) will cause by line 74 switches SW15 and SW18 each to adopt the position 2. Accordingly, switch SW15 now cuts off the bypass valve modulation mode to line 4, whereas switch SW18 ceases to apply line 500 to line 3 while line 5 bypasses SW1 through SW16, SW18 and line 512, for inlet valve modulation under the "pseudo setpoint" applied successively, by ramps RMP1 and RMP2, on lines 207' and 2' (FIG. 5).

When "loading" has been completed (instant $t_3$), and normal valve modulation is required, switch SW16 for lines 5 and 511 becomes opened, whereas switch SW17 becomes closed, so that the inlet valve can be controlled by lines 510 and 513, according to the modulation mode due to switch SW1. Similarly, after loading, switch SW13 is opened and switch SW14 becomes closed. Therefore, whenever needed bypass valve modulation will be performed according to the state of SW2 by lines 610 and lines 613.

When the bypass valve BV is closed (instant $t_1$), this is detected by a comparator 61 between line 72 (derived from line 7 at the reference zero) and line 73. In this case, comparator 61 by line 79 causes switch SW14 to close and switch SW13 to open. Line 79 also goes by line 76 to the setpoint circuit SPA in order to start ramping of ramp RMP1. Also when BV=0 (instant $t_1$), line 79 goes to an AND device where it meets with lines 78 and 79 having the logic "loading". Accordingly, line 74 will cause switch SW18 to go to position 2, thereby enabling inlet valve modulation from LPIV, and switch SW15 to go to position 2 , thereby disabling bypass valve modulation from LPBV. Now (at instant $t_1$), the ramp RMP1 has started on line 213 according to slope BC of curve (d) of FIG. 4B. It will follow through, then, ramp RMP2 take over from instant $t_2$ until instant $t_3$ at the rate of the clock signal delta' of line 216 (FIG. 5).

FIG. 7 is like FIG. 6 but more in terms of microcomputer operation (calculation of BKL and BKH, establishing the setpoint BKL initially, calculating cyclically for each ramp the new setpoint based on a delay between old and new). The same references as in FIG. 6 have been used as a guidance for reading FIG. 7. This transposition is general knowledge.

When the "pseudo-setpoint" of lines 207 and 207' reaches at instant $t_3$ the value of line 2, comparator OA10 will cause, by liner 203 switch SW10 to close and switch SW11 to open. Now, the assigned setpoint of line is directly applied on line 2'. Moreover, (as shown in FIG. 7) when the pressure of the tank matches the assigned setpoint of line 2', comparator OA12, which responds to line 82 (from line 2) and line 81 (from line 1), will by line 83 RESET the flip-flop (FF) which had been SET by the operator, via line 80, when pressing the push-button (PB) for "loading". Therefore, the logic of line 75 becomes "unloading". Loading has been terminated (instant $t_3$). Therefore, switches SW16, SW17, SW13 and SW14 (FIG. 6) return to position 1 ,and normal inlet valve or bypass valve modulation, according to the cross-referenced patent applications, will have been reinstated.

Figure 8:
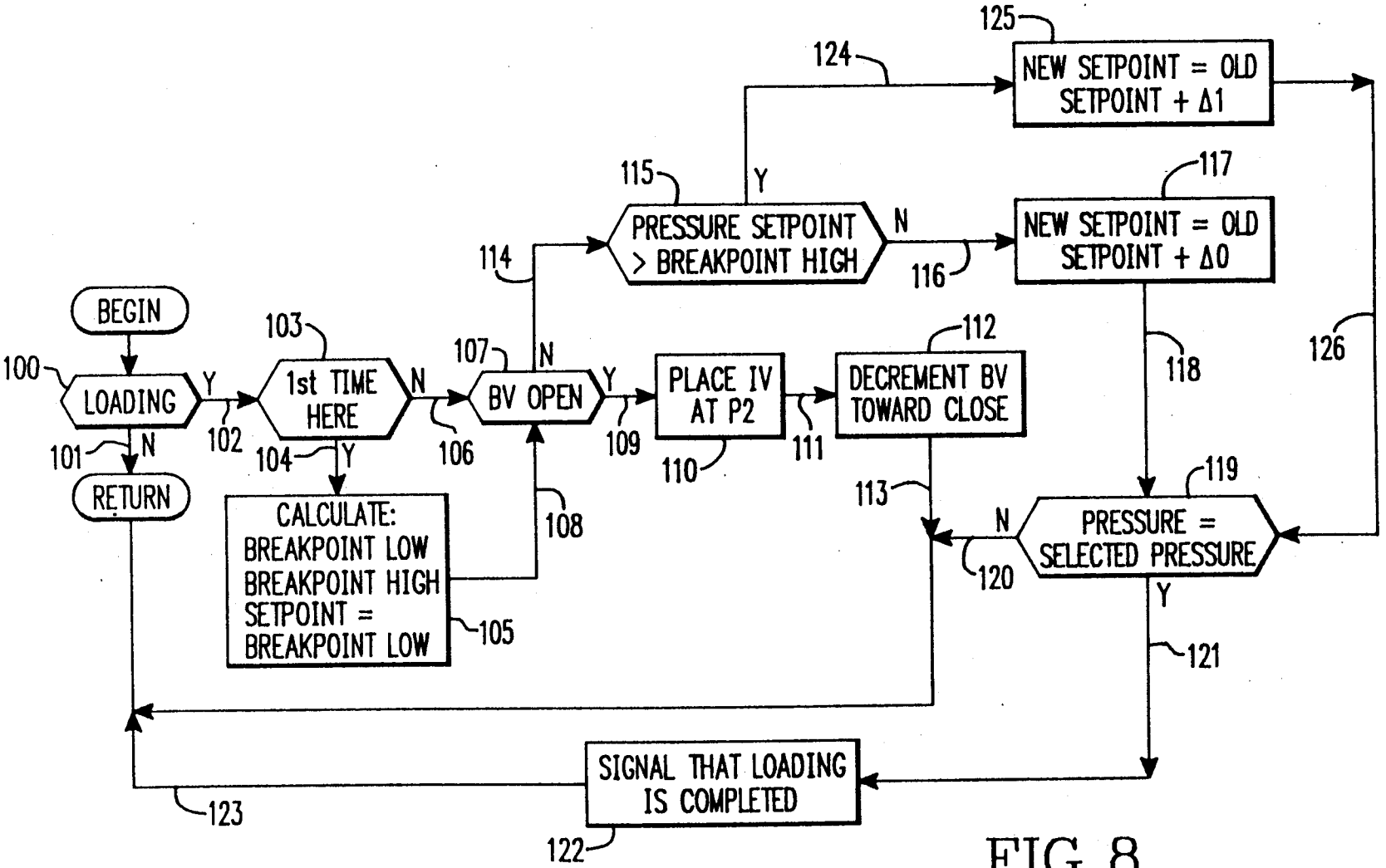
FIG. 8 is a flow chart illustrating the steps involved in a microcomputer treatment of the circuit of FIG. 7.

FIG. 8 is a flowchart illustrating the operation of the circuit of FIG. 7. At 100 the question is raised whether "loading" has been initiated by the operator. If NO, by line 101 the system Returns. If YES, by line 102 the question becomes at 103 whether it is the first time encountered after loading. If YES, by line 104 the system goes to 105 where the breakpoint BKL and the breakpoint BKH are calculated. Then, the "pseudo-setpoint" (instead of the setpoint value assigned for normal operation) is established at an initial value of BKL as just calculated. Thereafter, by line 108 the question becomes at 107 whether the bypass valve is still opened. The same question is raised by line 106 if at 103 the answer has been NO. If the bypass valve is still open, by line 109 the system goes to 110 where the inlet valve position is set at the value P2. Thereafter, by line 111, the step is taken at 112 to further close the bypass valve by successive decrements with a Return by line 113 after each decrement. Eventually, the bypass valve will be closed. This is ascertained at 107 by a NO on line 114. As a result, at 115, it is ascertained whether the pseudo-setpoint has become larger than BKH. If NO on line 116, at 117 are cyclically used the increment delta and the Old Setpoint to determine the New Setpoint. Each time the system goes by line 118 to 119 where it is observed that the Pressure has not become equal to the assigned setpoint pressure, and there is a Return by line 120. When at 115 the answer is YES, namely that the pressure has reached the value of BKH, namely of the upper elbow of the time function for the pseudo-setpoint, by line 124 the system goes to 125 where the new value New Setpoint is established cyclically in accordance with the last value Old Setpoint and the increment delta'. Thereafter, by line 126 the system goes via line 126 to 119 where the answer will eventually become YES. When this occurs, at 122 the system decides that Loading is completed. There is, thus, a Return by line 123, which will be followed by the other Routines for normal inlet valve and bypass valve modulation by the master-controller.

A LISTING, illustrating the operative steps of the microprocessor within the compressor control system according to the present invention, follows in the APPENDIX starting with Page A1.

I claim:

```
;STEPPOINT_PSUDO    modifies setpoint used in the load mode
;        step #2 in the following way.

;        IF in load step #2
;           IF bypass valve .NOT. closed
;              IF sap - 10 > 10
;                  incom_fp_psp = sap - 10
;              ELSE
;                  incom_fp_psp = sap
;              ENDIF
;           ELSE
;              IF incom_fp_psp + 5 < fp_psp
;                  incom_fp_psp = incom_fp_psp + 5
;              ELSE
;                  incom_fp_psp = fp_psp
;              ENDIF
;           ENDIF
;        ENDIF

;        It is called from the main loop in the place of the
;                  call to 'control_values'. The call to
;                  'control_values' is made from this module
;                  after incom_fp_psp is modified (if indeed, it
;                  should be modified as discribed above).


load_psudo_stpt    SEGMENT   CODE     UNIT
        RSEG       load_psudo_stpt


        PUBLIC     load_step2_stpt, set_psudo


        EXTRN      CODE   (control_values, comp2, shft4r, fetch_r01, fetch_r23)
        EXTRN      CODE   (fetch_ba, save_r01, save_r23)
```

```
        EXTRN      DATA  (temp1, temp2)

        EXTRN    NUMBER  (iinlet_signal)

        EXTRN     XDATA  (closed_blowoff, comp_ramp_flg, sap1, ls2_stpt, fp_psp1)
        EXTRN     XDATA  (incom_fp_psp1, psp_brkpt, psudo_delta, ramp_time)
        EXTRN     XDATA  (xbits_ad_unld)

        closd_bp1 equ     0FFH
        closd_bph equ      3
        sap_delta equ     10
        psudo_min equ     10       ;min psi for psudo setpoint
        psudo_brkpt_100   equ       4       ;breakpoint for fp_psp <= 100
                                            ;(i.e. fp_psp - psudo_brkpt_100 = brkpt)

load_step2_stpt:
        mov  dptr, #xbits_ad_unld    ;point to I_max adjusting bit
        movx a, @dptr                ;get it
        jb   acc.1, to_lse           ;setpnt adj'd because of I_max ?, YES ...
          mov   dptr, #ls2_stpt      ;point to this flags byte
          movx  a, @dptr             ;get it


          mov   b, a                 ;save it
          jb    b.3, adj_psudo       ;loading called from autodual ?, YES ...
            jnb b.0, ld_s2           ;ELSE ... finished step 2 ?, NO ...
              jnb  b.2, to_ls2_reset ;ELSE ... finished loading ?, YES ...
to_lse:           jmp lse            ;ELSE ... done - get out
to_ls2_reset:       jmp reset_ls2stpt
adj_psudo:
          jb    b.7, adj_bit3        ;unloaded via operator ?, YES ...
            jb b.6, adj_bit3         ;ELSE ... loading from START button ?, YES ...
              mov  dptr, #fp_psp1  ;ELSE ... point to operator sel'd setpnt lo
                call fetch_r23       ;r3,2 = fp_psp

              mov  dptr, #incom_fp_psp1  ;pnt to internal setpoint lo
                call save_r23        ;incom_fp_psp = r3,2

                mov  dptr, #sap1   ;point to system pressure lo
                call fetch_r01       ;r1,0 = sap

                call comp2           ;(c) = 1 if r1,0 < r3,2
                jnc  reset_it                ;incom_fp_psp >= sap ?, YES ...
                  mov    dptr, #xbits_ad_unld  ;ELSE ... point to delay bit
                  movx a, @dptr      ;get it
                  clr  acc.6                   ;tell label ad_mod in ccon.asm
                  movx @dptr, a      ;save it
                 sjmp lse
reset_it:
                mov      dptr, #xbits_ad_unld  ;point to delay bit
                movx a, @dptr                  ;get it
                setb  acc.6                    ;tell label ad_mod in ccon.asm
                movx @dptr, a                  ;save it

                mov  dptr, #ls2_stpt   ;point to these bits
                movx a, @dptr          ;get them
                sjmp reset_ls2stpt
```

```
adj_bit3:
          mov  dptr, #xbits_ad_unld        ;point to these bits
          movx a, @dptr            ;get them
          setb acc.3               ;remember that 1st time load in auto-dual
          movx @dptr, a

          mov  dptr, #ls2_stpt     ;point to these bits
          mov  a, b                         ;get them
          clr  acc.3
          sjmp setpoint_mod
ld_s2:
             ;the bit 6 will is set in the LOAD subroutine
             ; because the control setpnt 'incom_fp_psp' may be
             ; considerable less than fp_psp - therefore this
             ; test and subsequent is required

         jb b.6, setpoint_mod              ;in the load mode ?, YES ...
           jb  b.2, setpoint_mod   ;ELSE ... finished loading ?, NO ...
             jmp  reset_ls2stpt    ;ELSE ... end this module
setpoint_mod:
         setb   acc.2                      ;signal this step of load process
         clr    acc.6
         movx @dptr, a             ;'still loading' even if loadflg clear

         mov    dptr, #comp_ramp_flg       ;point to the load 'step' flag


          movx   a, @dptr            ;get it
          cjne   a, #-1, lse                ;load mode step #2 ?, NO ...
            call calc_delta                 ;ELSE ... calculate some psudo points

            mov  dptr, #closed_blowoff;point to bypass valve pos lo
            movx a, @dptr            ;get it
            cjne a, #closd_bpl, bpn ;bypass pos lo at close ?, NO ...
              inc  dptr              ;ELSE ... point to bypass valve pos hi
              movx a, @dptr                 ;get it
              cjne a, #closd_bph, bpn;bypass pos hi at close ?, NO ...
                  clr    acc.3              ;ELSE ... reset called from autodual flag
                  movx @dptr, a
                  sjmp inc_psudo  ;increment psudo setpoint
bpn:        mov  dptr, #ls2_stpt     ;point to incremented psudo setpoint bit
            movx a, @dptr            ;get it
            jb   acc.1, inc_psudo    ;incrementing psudo stpt ?, YES ...
                seth acc.1                  ;ELSE ... indicate this path taken
                movx @dptr, a
                jnb  acc.4, set_p  ;set_psudo called via UNLOAD ?, NO ...
                  clr  acc.4                ;ELSE ... clear this signal
                  movx @dptr, a   ;save it
                  sjmp lse
set_p:
                call set_psudo              ;set psudo setpoint
                sjmp lse
inc_psudo:   call psudo_inc            ;increment psudo stpt
              sjmp lse
reset_ls2stpt:
            jb     acc.7, lse                ;unload(ed/ing) via pnl switch ?, YES ...
              clr  a                         ;ELSE ... reset these flag bits
              movx @dptr, a
lse:
```

```
        call    control_values          ;update controller parameters
        ret
                ;* ***************
                ;This code reads the
                ; system air pressure &
                ; implements the following
                ; logic

                ;IF sap-delta0 > psudo_min
                ;   incom_fp_psp = sap - delta0
                ;ELSE
                ;   incom_fp_psp = psudo_min
                ;ENDIF
                ;* ***************
set_psudo:
        mov dptr, #sapl     ;point to system air pressure lo
        call fetch_ba               ;a,b = sap

        push acc            ;save sap hi

        mov a, b            ;get sap lo

        clr c                       ;clear this bit
        subb a, #sap_delta  ;subtract this delta
        mov r0, a                   ;save adj sap lo

        pop acc             ;restore sap hi
        subb a, #0                  ;adjust for carry
        jb  acc.7, went_neg         ;adj sap neg ?, YES ...
          mov r1, a                 ;ELSE ... save adj sap hi

          mov r2, #psudo_min        ;save adj psudo_min lo
          mov r3, #0                ;save adj psudo_min hi

          call comp2                ;(c) = 1 if r1,0 < r3,2
          jnc save_psudo            ;adj sap-sap_delta > psudo_min ?, YES ...
went_neg:  mov dptr, #incom_fp_pspl ;ELSE ... point to psudo setpoint lo
            mov a, #psudo_min       ;new 1
            movx @dptr, a           ;save it

            inc dptr                        ;point to psudo setpoint hi
            clr a                           ;new 2
            movx @dptr, a           ;save it

          ret

save_psudo:                                 ;save psudo setpoint
          mov dptr, #incom_fp_pspl  ;point to psudo setpoint lo
          call  save_r01            ;incom_fp_psp = r1,0
        ret
                ;* ***************
                ;increments the psudo setpoint
                ;* ***************
```

```
psudo_inc:
        mov  dptr, #incom_fp_pspl     ;point to psudo setpoint lo
        call fetch_ba                         ;a,b = incom_fp_psp

        push acc                      ;save psudo setpoin hi

        mov  dptr, #psudo_delta               ;point to this byte
        movx a, @dptr                         ;get it
        mov  templ, a                         ;save it

        mov  a, b                     ;get psudo stpt lo
        add  a, templ                         ;increment psudo stpt lo
        mov  r0, a                            ;save it

        pop  acc                      ;get psudo setpoint hi
        addc a, #0                            ;adj psudo stpt hi
        mov  r1, a                            ;r1,0 = incom_fp_pspl + psudo_delta

        mov  dptr, #psp_brkpt                 ;point to the break point lo
        call fetch_r23                        ;r3,2 = psp_brkpt

        mov  dptr, #incom_fp_pspl     ;point to psudo setpoint

        call comp2                            ;(c) = 1 if r1,0 < r3,2
        jnc  equ_fp                           ;adj psudo stpt > psp_brkpt ?, YES ...
          call save_r01               ;ELSE ... incom_fp_psp = r1,0

          mov   dptr, #ls2_stpt               ;pnt to incrementing psudo setpoint bit
          movx a, @dptr               ;get it
          setb acc.1                          ;set it
          movx @dptr, a               ;tell logic psudo stpt is increm't'ng
          ret

equ_fp:
        call     save_r23             ;incom_fp_psp = r3,2

        mov  dptr, #ls2_stpt                  ;pnt to 'finished this part of load' bit
        movx a, @dptr                         ;get it
        setb acc.0                            ;at the fpnl requested setpoint
        clr  acc.2                            ;clear it
        setb acc.5                            ;if called via autodual tell of this path
        clr  acc.7                            ;clear iinlet_signal
        movx @dptr, a                         ;tell system 'finished loading'

        ret
                ;* ******************
                ;Calculates the point at
                ;  which psudo setpoint
                ;  begins to change at a
                ;  rate of one (1) psi per
                ;  second.
                ;* ******************

calc_delta:
        mov      dptr, #ramp_time     ;pnt to operator selec'd psudo stpt delta
        movx     a, @dptr             ;get it
```

```
        mov  dptr, #psudo_delta              ;point to psudo_delta
        movx @dptr, a                        ;psudo_delta = (ramp_time)

        mov      dptr, #fp_pspl              ;point to operator selected setpoint lo
        movx     a, @dptr            ;get it
        mov      temp1, a            ;save it
        inc      dptr
        movx     a, @dptr            ;get hi portion
        mov      temp2, a            ;save it

        cjne     a, #0, calc_brkpt   ;fp_psp hi = 0 ?, NO ...
          mov  a, temp1              ;ELSE ... consider fp_psp lo
          cjne  a, #100, cdgt                ;fp_psp lo = 100 ?, NO ...
set_brkpt_lo: clr  c                         ;ELSE ... clear this bit
             mov  a, temp1
             subb a, #psudo_brkpt_100        ;(a) = fp_psp - (psudo_brkpt_100)
set_brkpt:    mov  dptr, #psp_brkpt     ;point to breakpoint byte lo
             movx @dptr, a             ;save breakpoint

             inc  dptr
             clr  a
             movx @dptr, a             ;set breakpoint byte hi
             ret

cdgt:        jnc  calc_brkpt           ;fp_psp lo > 100 ?, YES ...
             cjne a, #10, less_10      ;fp_psp lo = 10 ?, NO ...
                 sjmp set_brkpt_lo     ;ELSE ... force breakpoint
less_10:      jnc  set_brkpt_lo                ;fp_psp lo < 10 ?, NO ...
                mov  a, temp1
                 sjmp set_brkpt

        ;* ********************************
        ;multipling fp_psp by 4 and dividing by
        ; 128 results in approximately a 3 per
        ; cent of fp_psp rate of change for psudo_delta

        ;However, multiply by 4 is a shift twice to
        ;  the left and dividing by 128 is a shift 7
        ;  times to the right. Therefore a shift to
        ;  the right of only 5 times accomplishes the
        ;  same thing!  (temp2,1) = (fp_psp)
        ;* ********************************


calc_brkpt:
        clr      a
        mov      r6, a
        mov      r5, temp2
        mov      r4, temp1
        mov      r2, #4
        call     shft4r                      ;calc brkpt delta : result in r5,4

        mov      dptr, #psp_brkpt    ;point to the breakpoint lo
```

```
clr     c                       ;clear this bit
mov     a, temp1        ;get fp_psp lo
subb    a, r4
movx    @dptr, a        ;save breakpoint lo

mov     a, temp2
subb    a, r5
inc     dptr                    ;point to breakpoint hi
movx    @dptr, a        ;save breakpoint hi

ret
```

DKD

1. In a compressor system including a master-controller operative in one of an inlet valve modulation mode and a bypass valve modulation mode for controlling an inlet valve and a bypass valve of a compressor, respectively; the compressor supplying fluid flow to a load of smaller capacity than the compressor; the compressor being operative in response to a signal representative of the load pressure and to an assigned pressure setpoint; with means associated with the master-controller and responsive to an error between said load pressure and said assigned pressure setpoint for modulating the inlet valve in the inlet valve modulation mode and means associated with the master-controller and responsive to said error for modulating the bypass valve in the bypass valve modulation mode; the combination of :

means responsive to a loading signal generated when said bypass valve is open and said inlet valve is closed for substituting a pseudo-setpoint pressure signal for said assigned setpoint signal to the master-controller;

first means associated with the master-controller and responsive to said loading signal for bypassing said inlet valve modulating means and for establishing a minimum opening position for said inlet valve;

second means associated with the master-controller and responsive to said loading signal for bypassing said bypass valve modulating mean and responsive to said pseudo-setpoint signal for controlling the bypass valve to close;

said pseudo-setpoint signal being varied as a function of time between an initial minimum substantially less than the magnitude of said assigned pressure setpoint signal and the magnitude of said assigned pressure setpoint signal;

with said pseudo-signal being applied at said minimum initial magnitude until said second means has caused the bypass valve to close, and said function of time being initiated after said bypass valve has closed;

means being provided responsive to said load pressure signal and to said assigned pressure setpoint signal for cancelling said loading signal when the load pressure signal has become equal to said assigned pressure setpoint signal;

whereby said first and second master-controller associated means are enabled for normal valve modulation after loading.

2. The system of claim 1 with said function of time including at least one ramp of a selected slope from said initial minimum.

3. The system of claim 2 with said function of time including another ramp of a smaller slope than said one ramp, said another ramp being initiated when a predetermined magnitude close to said assigned magnitude has been reached under said one ramp.

4. The system of claim 3 with the compressor being driven by an electric motor at constant speed;

means being provided for deriving a signal representative of the motor current; and with the provision of means responsive to the difference between the magnitude of said current signal and a minimum current reference signal for selecting the bypass valve modulation mode, when the motor current under normal inlet valve modulation has exceeded said minimum current signal.

5. The system of claim 4 with said minimum current reference signal being to represent a minimum offset from an absolute minimum motor current corresponding to a minimum inlet valve opening for which the compressor insures a minimum airflow through the compressor.

6. The system of claim 5 with subcontroller means being provided responsive to the motor current representative signal and to a reference signal representative of said absolute minimum motor current for generating a compensating command signal for holding said inlet valve to a position corresponding to said compressor minimum airflow during compressor operation in the bypass valve mode.

* * * * *